US005955947A

United States Patent [19]

Sutsos et al.

[11] Patent Number: 5,955,947

[45] **Date of Patent: *Sep. 21, 1999**

[54] SECURITY STRUCTURE UNLOCKING SYSTEM FOR USE BY EMERGENCY RESPONSE PERSONNEL

[76] Inventors: Pete Sutsos, P.O. Box 140, Sonoma, Calif. 95476; Robert Triebel, 5523 Mulberry Dr., Santa Rosa, Calif. 95409; David Nisenson; Robert Baeyen, both of 850 W. Napa St., Sonoma, Calif. 95476

[ * ] Notice: This patent is subject to a terminal disclaimer.

[21] Appl. No.: 08/764,502

[22] Filed: Dec. 12, 1996

[51] Int. Cl.[6] ..... E05B 45/06

[52] U.S. Cl. ..... 340/542; 340/825.69; 340/825.72; 340/904; 340/539; 340/825.31

[58] Field of Search ..... 340/542, 506, 340/902, 904, 539, 825.31, 825.69, 825.72, 825.73

[56] References Cited

U.S. PATENT DOCUMENTS

| | | | |
|---|---|---|---|
| 4,616,444 | 10/1986 | Taylor | 340/541 |
| 4,667,440 | 5/1987 | Grace | 340/541 |
| 5,325,084 | 6/1994 | Timm et al. | 340/541 |
| 5,680,119 | 10/1997 | Magliari et al. | 340/904 |

OTHER PUBLICATIONS

B.F. Goodrich Aerospace, "Radio Control", Lighting Systems Division, Oldsmar, Florida.

*Primary Examiner*—Jeffery A. Hofsass
*Assistant Examiner*—Daryl C. Pope
*Attorney, Agent, or Firm*—Flehr Hohbach Test Albritton & Herbert

[57] ABSTRACT

An emergency response security structure-opening assembly for use in unlocking a locked structure comprising: a radio frequency receiver formed to detect only uncoded radio frequency signals on a restricted emergency radio frequency; an actuator coupled to said receiver and formed for coupling to one of a security structure lock assembly and an unlocking mechanism for a security structure lock assembly at a position by-passing any authorized user input device; said receiver being responsive to detected signals to actuate said actuator and produce unlocking of said lock assembly.

A method for providing an emergency response security structure-opening system for a locked structure having an authorized user input device comprising the steps of: coupling a radio frequency receiver assembly to a lock assembly for said locked structure at a position by-passing said authorized user input device, said receiver assembly being formed to detect the presence of signals on only a restricted emergency radio frequency and formed to be responsive to a detected signal to unlock said lock assembly; and unlocking said lock assembly by transmitting a signal on said restricted emergency radio frequency to receiver.

13 Claims, 1 Drawing Sheet

SECURITY STRUCTURE UNLOCKING SYSTEM FOR USE BY EMERGENCY RESPONSE PERSONNEL

TECHNICAL FIELD

The present invention relates to systems for unlocking gated areas and more particularly to systems for unlocking gated areas using remote radio controlled devices.

BACKGROUND AND OBJECTS OF THE INVENTION

Privately-gated communities, privately-gated residences, restricted government access areas, garage-door openers and lock boxes, and other restricted access or gated areas provide security against potential intruders but have the disadvantage of hindering emergency response personnel, such as police, fire and ambulance services, from quickly entering the gated area as required in emergency situations. This is due to the fact that security gates or other structures are designed to require an operator either to carry keys or to know access entry codes in order to open such secure structures. Consequently, the entering of such a gated or access-restricted area presents considerable problems for emergency personnel trying to move swiftly through, or respond to calls in, such a gated area, or when trying to open a restricted-access area. What is instead desired is a system in which the security structures are effective barriers to unauthorized personnel and yet emergency personnel are able to quickly and easily enter these areas. It is, accordingly, an object of the present invention to provide a remote controlled system enabling emergency response personnel to quickly and easily enter restricted-access areas such as privately-gated residences and communities without having to carry keys or know access codes for each locked gate or other security structure.

Another important design consideration is that the desired gate-opening system must be designed such that only licensed emergency personnel are able to operate the system. If this were not the case, and if other individuals were able to operate, tamper or break into this system, the very security purpose of the security structure itself would be compromised as this structure would be easily openable by unauthorized personnel. Accordingly, it is an object of the present system that it cannot be operated by anyone other than licensed emergency response personnel.

Having security structures including the gates of privately-gated communities, residences or lock boxes for residences, industrial buildings or other security structures openable by some form of remote control device located in the emergency response vehicle itself would enable such structures to be opened easily and in a timely fashion without emergency response personnel even having to get out of their vehicles. It is accordingly an object of the present invention that an emergency response person be able to open security gates, doors and other locked enclosures without even having to leave their vehicle.

Existing remote control door opening devices, (such as garage door openers), are typically designed to be operated at a selected control frequency such that a door or gate is opened in response to the transmission of a coded signal over the particular frequency from a limited range, remote control transmitter. With such devices, different coded signals are used to open different doors or gates. By having the range of transmitters limited simply by their relatively low power and by having various garage door openers each set to different codes for their activation, the chance of any garage door opener inadvertently opening a neighbor's garage-door is remote. Fundamental problems exist with attempting to adapt this form of door opening system to solve the present problem, as set out below.

Being set at a specific pre-set coded signals, a separate garage door opener is required to open virtually every garage door. It is, accordingly, another object of the present invention that this problem be overcome by providing a universal emergency response gate-opening system designed to allow an emergency response person or team to open many different private gates without being required to have and operate a plurality of different coded gate-opening devices corresponding to each of the various locked gates.

It is a further object of the present invention to provide a system which would not be easily openable by various public-access radio frequency transmissions. It is still another object that the use of the universal emergency response gate opening system of the present invention will not inadvertently unlock other neighboring locked gates in the vicinity of the particular locked gate which is desired to be opened.

Moreover, it is another object of the present invention that emergency personnel should not be required to carry an additional security-structure opening device in addition to all the other emergency equipment which they must now carry. Such an "extra" device would need to be issued to all emergency personnel, including police, fire, ambulance, etc. This raises the problem of certain emergency personnel inadvertently not being issued with such equipment. This "extra" device could inadvertently be lost and thus fall into the hands of an unauthorized person. In addition, it is an object of the present invention that the system not be limited to operate only in a particular geographic area or only with a few pre-selected locked structures. Moreover, the universal security-structure unlocking system should not be difficult or time consuming to operate or to learn to operate.

Furthermore, it is an object that the present security-structure opening system not require excessive retro-fitting to be installed nor require technical equipment modification or standardization to be operable by a variety of existing emergency response agencies. Thus, this system should be easily adapted for use by police, ambulance and fire department personnel without the need for any inter-agency co-ordination. As such, it is yet another object that this system be adapted to augment the usefulness of existing devices already used and carried by emergency response personnel as this would eliminate the need for extensive equipment modification or retrofitting.

Various systems already exist for remotely opening gates through the use of various radio controlled devices. Examples may be found in U.S. Pat. No. 4,616,444 to Taylor and U.S. Pat. No. 4,667,440 to Grace, Sr. Unfortunately, these systems are very limited in addressing all the security concerns of the present invention as these patented devices do not disclose any security features in regard to the actual radio controlled operation of their gate opening systems. Rather, the systems of the Taylor and Grace patents simply disclose that some existing form of radio transmitters, presumably coded signals, can be used to activate the gate opening system. These systems, therefore, are not adaptable to solve the present problems of emergency response personnel desiring to quickly open privately-gated residences and communities.

DISCLOSURE OF THE INVENTION

The present system provides a locked structural assembly comprising: a structure having a movable security structure and a lock assembly formed to lock the security structure in a closed position; an unlocking mechanism coupled to and formed for unlocking of the lock assembly; and an emergency response security-structure opening assembly coupled to the unlocking mechanism at a position by-passing an authorized user input device and including a radio frequency receiver formed to detect the presence of a radio frequency signal on at least one restricted emergency radio frequency, and the security structure opening assembly further being responsive only to detection of the signal in the restricted emergency radio frequency to actuate the unlocking mechanism.

Also disclosed is an emergency response security structure opening assembly for use in unlocking a locked structure comprising: a radio frequency receiver formed to detect only uncoded radio frequency signals on a restricted emergency radio frequency; an actuator coupled to the receiver and formed for coupling to one of a security structure lock assembly and an unlocking mechanism for a security structure lock assembly at a position by-passing any authorized user input device; the receiver being responsive to detected signals to actuate the actuator and produce unlocking of the lock assembly.

The present invention also provides a method for providing an emergency response security structure opening system for a locked structure having an authorized user input device comprising the steps of: coupling a radio frequency receiver assembly to a lock assembly for the locked structure at a position by-passing the authorized user input device, the receiver assembly being formed to detect the presence of signals on only a restricted emergency radio frequency and formed to be responsive to a detected signal to unlock the lock assembly; and unlocking the lock assembly by transmitting a signal on the restricted emergency radio frequency to receiver.

In addition, the present invention provides a method for opening a locked structure using a remote radio transmitter, the locked structure being equipped with a radio frequency scanner/receiver coupled to control an unlocking mechanism connected to a lock assembly for the structure, comprising the steps of: (a) monitoring at least one emergency radio frequency with the scanner/receiver to detect radio signals transmitted on the at least one radio frequency, (b) concurrently with the step of monitoring at least one radio frequency, operating the remote radio transmitter to transmit a radio signal on the at least one emergency radio frequency, (c) receiving the radio signal via an antenna connected to the scanner/receiver, the antenna being adapted to have a very short range, and (d) signaling the unlocking mechanism to unlock the locked structure in response to receipt of the signal.

BRIEF DESCRIPTION OF THE DRAWING

The FIGURE is a schematic block diagram of the present invention.

BEST MODE OF CARRYING OUT THE PRESENT INVENTION

Figure 1:
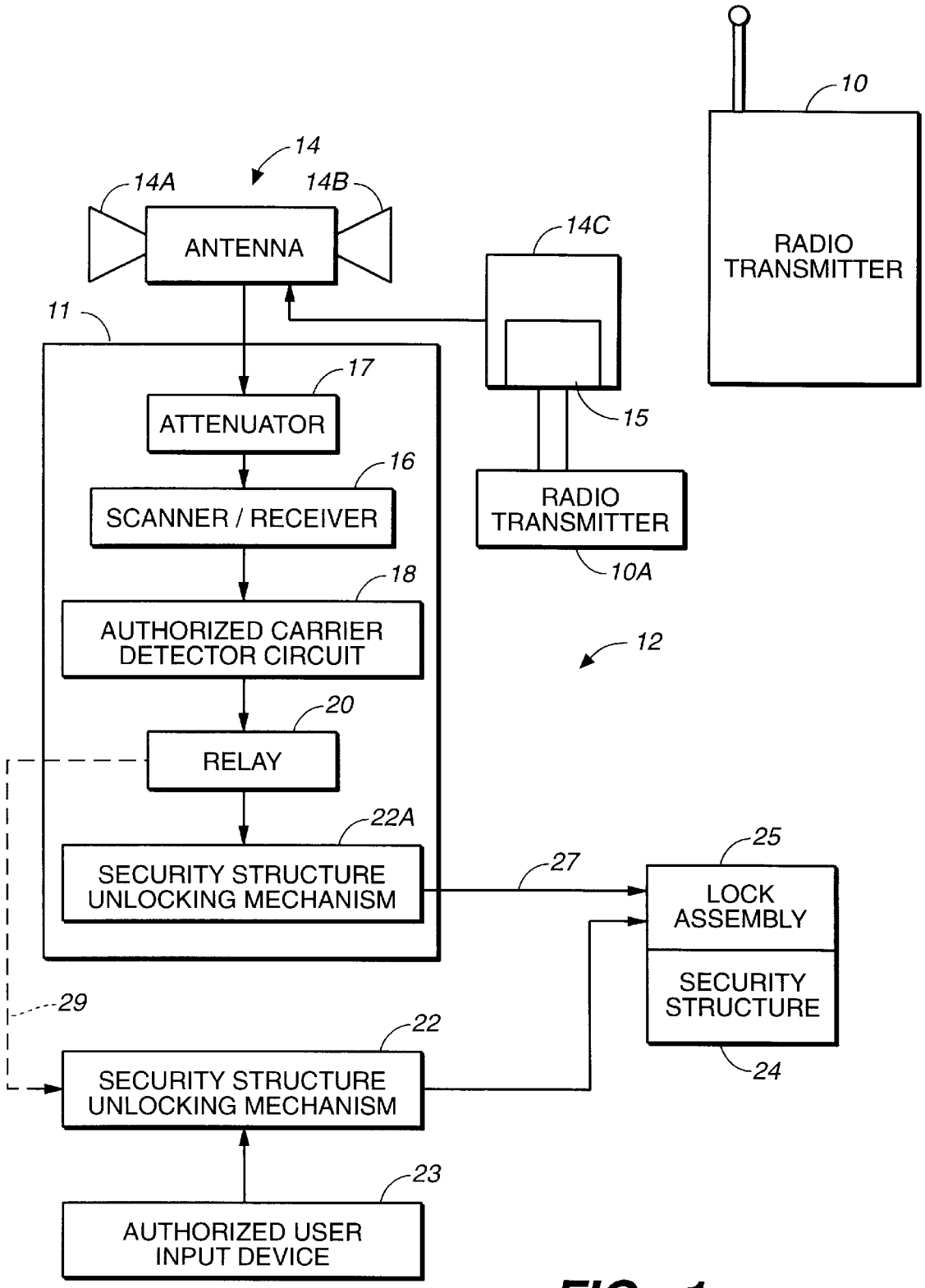

Privately-gated homes, locked government and industrial complexes and schools, gated communities and multiple user lock boxes all pose problems for emergency response personnel attempting to quickly and easily enter or pass through these gates or locked entrances in times of emergency. The present invention provides an apparatus and method for emergency response personnel to quickly and easily open private locked security structures without having to carry keys and without knowing access codes, and most preferably, without even having to exit from their vehicles. This emergency response security structure opening system is not operable by persons other than licensed emergency response personnel and has the further advantage that personnel from different emergency response agencies can use the same system to open different locked security structures in different geographic areas, without the risk of inadvertently opening other security structures in the vicinity.

Referring now to the FIGURE, a block diagram of a universal, emergency-response security structure opening system constructed in accordance with the present invention is shown. A security structure such as a gate, door or lock box 24 provided with a lock assembly 25 which is connected to a security structure unlocking mechanism 22. As used herein, "security structure" shall include any structural closure member. Unlocking mechanism 22 can be a solenoid or other actuator which usually will be electrically powered and is connected to an authorized user input device 23. Input device 23 can be a key pad for manual input of an authorized user opening code, or it could be a radio frequency receiver, an optical receiver or any other form of input device to unlocking mechanism 22, including a key-receiving tumbler lock.

Thus, if input device 23 receives radio frequency signals from an authorized user-held radio transmitter (not shown) the system for unlocking security structure 24 would essentially be a garage door opening system. A coded signal would be transmitted to input device 23, which would be responsive only to such a coded signal on a predetermined transmission frequency to open lock assembly 25 for security structure 24.

Such equipment, of course, is generally employed in gated structural applications such as houses, communities, industrial complexes or other security structures such as lock boxes. Since each house/community complex lock box will have its own unique coding system for authorized users, multiple security structures will require multiple coded authorized user devices for emergency agencies.

Accordingly, in the system of the present invention an emergency response security structure opening assembly, generally designated 12, is coupled to lock assembly 25 for security structure 24 to enable by-passing of the authorized user input device 23. Emergency response security structure opening assembly 12 can have its own security structure unlocking mechanism or actuator 22A so as to be a completely stand-alone assembly which is coupled directly to lock assembly 25, as indicated by arrow 27. Alternatively, auxiliary security structure unlocking mechanism 22A can be eliminated and the output of assembly 12 coupled to the existing security structure unlocking actuator or mechanism 22 for lock 25, as indicated by arrow 29.

The emergency response security structure unlocking system of the present invention includes two main components, namely, a radio frequency transmitter 10 and the security structure opening assembly 12. As is broadly the case for garage door opener systems, the present system transmitter 10, which is operated by emergency response personnel and produces a radio frequency signal that is received by antenna 14 of a receiver 16. In the present system, however, the transmitted signal is not encoded and the receiver 16 is preferably a receiver/scanner.

Emergency response personnel, regardless of whether they are police, fire, ambulance, forestry, customs, etc. are all typically equipped with radio transmitters for communication with a dispatcher or base station and for communication with other emergency response personnel. The particular radio frequencies upon which messages are transmitted are restricted by the Federal Communications Commission (FCC) in the United States, and by similar regulatory agencies in other countries, such that private individuals may not legally broadcast on emergency response restricted frequencies or even possess devices for transmitting signals on such restricted frequencies. Although transmission upon emergency response frequencies is restricted only to licensed emergency response agencies, the reception of these transmissions is not restricted and private individuals may lawfully receive such signals. By contrast, the FCC assigns different frequencies for commercially available remote door opening systems generally available to the public and anyone can possess a transmitter suitable for transmitting signals on such frequencies. Input device 23, for example, would operate on a generally available FCC non-emergency response frequency. The present system applies the principle that emergency response agencies' radio transmissions are broadcast only on restricted access radio frequencies, while other remotely operated systems are broadcast on publicly available frequencies, to provide a system for opening locked security structures.

Scanner 16 of the present invention, therefore, is constructed to scan only the emergency response frequencies assigned by the FCC to the particular area in which security structure 24 is located. Standard emergency response radio transmitter 10, which is typically mounted in an emergency response vehicle, will be transmitting signals on emergency frequencies while unauthorized user transmitters will not. Scanner 16 is preferably a slightly modified version of one of the well known existing type of scanners that sequentially scan a number of different frequencies used by the various emergency response personnel in the area. These existing scanners are designed to monitor one pre-set or pre-programmed emergency response frequency for a short period of time, and if no transmissions are detected on this frequency, they then adjust to monitor another pre-set emergency response frequency for a short period of time. The steps of switching between various pre-set frequencies are repeated as each pre-set frequency is monitored in turn. In such systems, if transmissions are detected on any of the pre-set frequencies, the scanner is designed to then remain tuned to this frequency so that a user is able to listen in on the radio conversation through the system's accompanying loudspeaker. The frequencies which such scanners are adapted to monitor are typically either pre-programmed directly into the scanner, in the case of the newer more advanced models, or are pre-set with each frequency to be monitored are fixed on individual computer chips which are received onto a bank of sockets, in the case of older models of scanners.

The present scanner 16 is similarly constructed to these prior art scanners. The difference between the present scanner and prior art scanners is that if the present scanner 16 detects transmission broadcasts on any of the frequencies being monitored, under certain conditions it is adapted to signal a relay circuit 20 which in turn activates security structure unlocking mechanism 22 or 22A to unlock security structure lock 25 and security structure 24. Furthermore, for reasons to be explained herein, the present scanner 16 need not be operated such that it remains tuned to a particular frequency for an extended period of time simply because radio transmissions were detected on this monitored frequency. Also important to the present system is the fact that the signal sent from scanner 16 to security structure unlocking mechanism 22, 22A preferably passes through an authorized carrier detection circuit 18, before reaching relay circuit 20, the purpose and function of which will be described below.

As frequencies used by emergency response personnel may vary from one geographic area to another, it is important that the programmer or installer of scanner 16 customize the set-up of the scanner such that the particular frequencies which the scanner monitors can be adjusted. Scanner 16 may either be of the type in which the frequencies to be monitored are pre-programmed or of the type in which the frequencies to be monitored are individually fixed on computer chips which are received onto a bank of sockets in the scanner. The security advantage with using the latter type of scanner in the present system is that it can not be broken into such that other, non-restricted radio frequencies could be set to activate the emergency door opening system. Although the possibility exists that unauthorized persons could possess illegal equipment allowing them to make radio transmissions on restricted emergency frequencies, thus allowing them to open the locked security structure, the potential for this type of activity is greatly reduced as such transmissions, by definition, have to be made on frequencies monitored by emergency response personnel, thus alerting them to the presence of unauthorized users.

A particular advantage of the present system is that scanner 16 can be pre-programmed to respond only to certain emergency response agencies as desired by the security structure owner. Typically, scanner 16 will be pre-programmed such that the radio frequencies used by police, fire and ambulance agencies in the local geographic area will be monitored by the scanner. In addition, however, additional radio frequencies such as those used by other agencies such as the National Forestry Service, Customs officials, etc. may also be selectively added to the present scanner. As the particular radio frequencies which activate the present system are pre-programmed into the scanner 16, the addition or deletion of any particular agency's ability to command the unlocking of the locked security structure by the present system would remain under the control of the security structure owner, allowing selective security structure opening by desired agencies only.

It is further within the scope of the present invention that scanner/receiver 16 be only a receiver pre-programmed to receive radio frequency signals at only one emergency response frequency. In the broadest case, therefore, the security structure opening system includes a radio frequency receiver formed to receive signals on at least one emergency response frequency and to respond thereto to cause unlocking of security structure or lock box 24.

To provide a truly secure system, the present invention is also provided with numerous practical safeguards so that it will not allow the unlocking or opening of a secure locked security structure whenever an emergency response team uses its radio transmitter in the neighborhood of receiver/scanner 16 and locked security structure 24.

First, antenna 14, which is connected to scanner/receiver 16, is preferably "crippled" or has its receiving sensitivity reduced such that it preferably has a very short range. Being "crippled", it is therefore only able to receive transmissions from a emergency response vehicle's transmitter 10 if transmitter 10 is positioned in very close proximity to antenna 14. Ideally, "crippling" of the antenna reduces its ability to receive radio transmissions to such a degree that the radio transmitter used by the emergency personnel is required to actually be within several yards of the antenna 14, typically necessitating the emergency response vehicle itself be driven to a position just in front of the security structure to be opened.

Antenna 14 can be crippled by several means. First, an attenuator 17, (preferably a resistive "T" pad attenuator), can be inserted between antenna 14 and scanner/receiver 16. The use of attenuator 17 "cripples" the reception and thereby limits the sensitivity of antenna 14. The factors upon which the attenuation requirements are to be based can preferably include the decibel attenuation required and the impedance of the transmission line. Secondly, antenna 14 may also be "crippled" by shielding the antenna with a shielded horn, which gives antenna 14 directional sensitivity, as will be explained below. The orifice of the shielded horn may be covered by a clear plastic preventing weather damage, yet allowing access to radio waves. Thirdly, the use of metal shielding can be used to prevent unwanted radio transmissions from entering the system. The "crippling" ensures that the locked security structure is only opened by the present security structure opening system when an emergency response transmitter is in its immediate presence. "Crippling" of the reception sensitivity of antenna 14 thus ensures that the security structure is not inadvertently unlocked or opened simply by any of the normal emergency response radio transmissions which are continuously occurring throughout the neighborhood. Rather, radio transmitter 10 must be positioned quite near antenna 14 before the "crippled" antenna will pass such transmissions through to scanner/receiver 16.

"Crippling" of the receiving sensitivity of antenna 14 has the added advantage that no modification need to be made to the relatively high output wattage of radio transmitters 10 which are carried by the various emergency response personnel on their person or in their vehicles. Rather, high powered transmitters 10 need not have their power reduced or their ability to communicate over large distances compromised as is, of course, necessary for emergency agencies. Antenna 14 of the present invention, therefore, is adapted only to have sufficient sensitivity to pass even high-powered radio transmissions only when they are sent in the very near proximity to antenna 14.

As stated above, in addition to being "crippled" as to the distance at which the antenna is able to sense radio signals, the shielded horn covering antenna 14 also enables the antenna to be "crippled" as to the direction from which the antenna senses signals. Accordingly, having such limited directional sensitivity, it is possible to position antenna 14 such that transmitter 10 must be positioned directly in front of antenna 14 for the radio signal from transmitter 10 to be sensed and passed through to scanner 16. Preferably, antenna 14 can be mounted on a post near locked security structure 24 and positioned to face the direction from which an emergency vehicle would approach this locked security structure. Accordingly, directional shielding might require that the transmitter face the opening of the shielded horn covering antenna 14 such that an emergency vehicle would have to pull up in front of the locked security structure in order to trigger the security structure unlocking mechanism. For example, the emergency vehicle would pull into the driveway in the case of the locked security structure being a gate spanning the driveway. As can be appreciated, this directional sensitivity of antenna 14 provides further assurances against radio transmissions inadvertently opening security structure 24. Furthermore, in the case of a locked security structure 24 across a road or path customarily having two-way traffic, antenna 14 can either be shielded to be bi-directional, having horns 14A and 14B, or alternately, two separate antennas can be used, with one corresponding to the direction of ingress and the other to the direction of egress. Mounting antenna 14 on a pole above ground would further provide security against acts of vandalism.

Preferably, scanner 16, authorized carrier detector circuit 18 and relay 20 all will be mounted together in a secure housing 11. The scanner/receiver/security structure opener system 12 is preferably powered by a 12 or 24 Volt D.C. power supply. Housing 11 may preferably be mounted on or next to the locked security structure itself, and coupled to drive existing security structure unlocking actuator 22 or provided with its own unloading actuator 22A.

As the present antenna 14 has a "crippled" or reduced sensitivity, it can only sense radio transmissions made from emergency response vehicle radios within several feet of antenna 14. However, emergency response personnel also often carry hand-held radio transmitters which are typically much weaker in power than the transmitters found in emergency response vehicles. The present invention is also adapted to enable use of these much weaker transmitters to open security structures and lock boxes. Specifically, antenna assembly 14 preferably has a shielded access port 15 into which antenna 31 of a hand-held transmitter 10A can be inserted. Access port 15 is preferably kept shielded from the environment by a spring-activated door. As is seen in the FIGURE, access port 15 can be positioned in a separate antenna 14C which is placed at a location removed from that of antennas 14A and 14B. Such remote positioning of antenna 14C is particularly useful when positioning antenna 14C at a height within easy reach of an emergency response person holding a radio transmitter 10A, yet still enables antennas 14A and 14B to be attached to a pole at greater out-of-reach height above the ground as a precaution against vandalism. Although access port 15 can be positioned in a remote antenna 14C, it is also within the scope of the present invention, however, to locate access port proximal antenna assembly 14, which may or may not consist of separate antennas 14A and 14B. By positioning the antenna of hand-held transmitter 10A directly into access port 15, the same control over opening the locked security structure is achieved as would be achieved by the more powerful transmitter 10 being located in the emergency response vehicle located several yards from antenna 14.

A further important safeguard may be used to ensure that the radio transmissions made by an emergency response vehicle's transmitter do not inadvertently open a locked security structure when the vehicle is simply driving by the locked security structure. This safeguard is accomplished using an authorized carrier detection circuit 18 to determine whether the radio transmission is intended to open security structure 24 or is merely a spurious transmission. One convenient way of distinguishing between intended and spurious transmissions is to require that the transmission be pulsed on and off a number of times within a pre-programmed fixed time interval. Authorized carrier detector circuit 18 is actuated by the reception of an emergency response radio transmission signal detected by scanner 16. The authorized carrier detector circuit then waits a specific pre-programmed time interval to detect whether the signal monitored by scanner 16 is repeated. The wait time of this pre-programmed time interval is preferably controlled by a timing device (e.g., a 555 timer chip) in the authorized carrier detector circuit. A logic device chip in the authorized carrier detector circuit 18 will preferably be used to validate whether the monitored radio transmission is pulsed on and off a certain required number of times in the pre-programmed time interval. Detector circuit 18 will, therefore, act as a system buffer, screening out most radio transmissions which are not intended to open the locked security structure. When the authorized carrier detector circuit 18 has determined that the monitor of radio transmission has been pulsed on and off by the emergency response person the required number of times within the pre-programmed time interval, the circuit will signal relay 20 to activate security structure unlocking mechanism 22.

The authorized carrier detector circuit can be activated by various methods including (1) the DC shift from an automatic gain control circuit in scanner/receiver 16 reacting to the presence of a received carrier signal or (2) the presence of the approximately one second "squelch tail" present at the audio output of scanner/receiver 16. This "squelch tail" occurs at the end of a received carrier signal and is inherent to all FM receivers employing a squelch circuit to quiet the output of the receiver during the absence of a received carrier signal. In other words, the present system will only operate to unlock the security structure if the microphone transmitter key switch or activation button of the emergency response persons' radio transmitter is rapidly and repeatedly turned on and off in the immediate presence of the security structure unlocking system's antenna. This further ensures that spurious signals will not unlock security structure 24, even if these transmitters are positioned relatively near to the locked security structure.

Present scanner 16 scans each of the particular pre-programmed emergency response frequencies for a particular pre-programmed period of time, typically on the order of less than one second. During this pre-programmed period of time, the authorized carrier detection circuit 18 is used to determine whether the detected communications sent on this frequency have been pulsed on and off a pre-programmed number of times (typically being set as two to four times), within this pre-programmed scan period of time.

Accordingly, the only procedure required to be learned by the emergency response personnel to open a locked security structure having security structure opening assembly 12 coupled thereto is to position themselves rather close to the security structure and then rapidly turn their microphone transmitter key switch or activation button on their radio transmitter on and off several times. No adjustment need be made to their existing equipment and no coded signals need be sent. Another advantage is that different procedures do not need to be adopted by different agencies to open different locked security structures. Furthermore, the present system ensures that regular routine communications made over restricted radio frequencies are not sufficient by themselves to inadvertently open these locked security structures. Rather, a more conscious and positive act of rapid turning on and off the radio transmitter 10 by emergency response personnel is required. The rapidly pulsing on and off of the radio microphone transmitter key or activation button on transmitter 10 is a very simple act, which can very quickly and easily be performed by the emergency personnel desiring to open a locked security structure. Finally, even in the event that the particular security structure desired to be opened by the present security structure unlocking system is not so equipped with the present security structure opening system, the amount of time "wasted" in attempting to open the security structure by simply quickly turning the microphone transmitter button on the radio transmitter on and off would be exceptionally small.

Security structure unlocking mechanism 22 is not, by itself, a novel feature of the present invention. Accordingly, it may include any existing actuator mechanisms for unlocking or unlocking and opening security structures, as long as such mechanisms are electronically controllable.

What is claimed is:

1. A secure structural assembly comprising:

a movable security structure having a closed, locked position and an opened, unlocked position;

a lock assembly formed to lock said movable security structure in its closed position;

an unlocking mechanism coupled to and formed for unlocking of said lock assembly;

an authorized user input device coupled to the unlocking mechanism and formed to unlock the lock assembly in response to an authorized user input through said user input device; and a separate security structure-opening assembly coupled to said unlocking mechanism at a position bypassing said authorized user input device and including a reduced sensitivity radio frequency receiver responsive to at least one of a short duration radio frequency signal transmitted only from a limited range away from said receiver on a restricted radio frequency, and said security structure-opening assembly further being responsive only to detection of said signal in said radio frequency to actuate said unlocking mechanism;

said reduced sensitivity radio frequency receiver is a scanner formed to scan a plurality of restricted emergency radio frequencies to detect the presence of pulsed signals within a known time interval on one of said restricted emergency radio frequencies.

2. The secure structural assembly as defined in claim 1 wherein, said scanner has a reduced sensitivity antenna formed to detect signals only from a very near range.

3. A secure structural assembly as set out in, claim 1 wherein, said reduced sensitivity receiver includes an antenna mounted in a shielded horn.

4. A secure structural assembly as set out in claim 1 wherein, said reduced sensitivity receiver includes an antenna mounted in a port formed for insertion of a hand-held radio transmitter antenna therein.

5. An emergency response security structure-opening assembly for use in unlocking a locked structure comprising:

a reduced sensitivity radio frequency receiver formed to detect radio frequency signals on a restricted emergency radio frequency transmitted only from a very near range;

an actuator coupled to a lock assembly and formed to unlock said structure;

an authorized user input device for receiving authorized user input other than on a restricted emergency radio frequency, said authorized user input device being operatively coupled to said actuator and being responsive to authorized user input to cause said actuator to unlock the lock assembly; and said receiver being coupled to said actuator at a position bypassing said authorized user input device and being responsive to detected non-continuous signals to actuate said actuator and produce unlocking of said lock assembly so as to enable unlocking of said lock assembly by emergency response personnel using unmodified radio transmitter equipment transmitting on a restricted emergency radio frequency only from a very near range.

6. The security structure-opening assembly as defined in claim 5 wherein, said reduced sensitivity receiver is provided as a scanner formed to scan a plurality of restricted emergency radio frequencies.

7. The security structure-opening assembly as defined in claim 6 wherein, said scanner is coupled to a detector circuit, and said detector circuit is formed to actuate said actuator only upon receipt of a plurality of signals within a predetermined time interval.

8. A method of opening a secure structure having an authorized user input device for a user of the secure structure to gain access thereto, comprising the steps of:

coupling a radio frequency receiver assembly to a lock assembly for said secure structure at a position bypassing said authorized user input device, said receiver assembly having reduced sensitivity so as to only detect the presence of signals transmitted from a limited range on a restricted radio frequency not used by said authorized user input device, said receiver assembly also being formed to be responsive to detection of at least one of a pulsed and a coded radio frequency signal to unlock said lock assembly;

continuously operating said receiver assembly to monitor said restricted radio frequency for signals transmitted from a near range to said receiver assembly; and unlocking said lock assembly by transmitting a signal on said restricted radio frequency at a near range from said receiver assembly.

9. The method as defined in claim 8 wherein, said coupling step is accomplished by coupling a scanner/receiver to said lock assembly, said scanner/receiver being formed to scan a plurality of only restricted emergency radio frequencies to detect signals thereon.

10. The method as defined in claim 8 wherein, said transmitting step is accomplished by transmitting signals from an emergency response vehicle located in close proximity to said locked structure.

11. The method for opening a secure structure as set out in claim 9, and the step of:

using an authorized carrier detector circuit located in said scanner/receiver to determine if said radio signal is repeatedly pulsed on and off within a fixed interval of time, and during said transmitting step, transmitting a repeated pulsed on-off signal within a predetermined time interval.

12. The method for opening a locked structure as set out in claim 11 wherein, said fixed interval of time is less than four seconds.

13. The method for opening a secure structure as set out in claim 9 wherein, said transmitting step is accomplished by transmitting signals from a hand-held remote radio transmitter by an emergency response person.

* * * * *